US006129003A

United States Patent [19]

Udagawa

[11] Patent Number: 6,129,003

[45] Date of Patent: Oct. 10, 2000

[54] FLUID-PRESSURE CYLINDER APPARATUS

[75] Inventor: Hiroshi Udagawa, Ibaraki, Japan

[73] Assignee: SMC Corporation, Tokyo, Japan

[21] Appl. No.: 09/139,729

[22] Filed: Aug. 25, 1998

[30] Foreign Application Priority Data

Sep. 19, 1997 [JP] Japan ..... 9-273972

[51] Int. Cl.[7] ..... F01B 7/20

[52] U.S. Cl. ..... 92/51; 92/165 PR; 92/136

[58] Field of Search ..... 92/51, 52, 165 PR; 91/169

[56] References Cited

U.S. PATENT DOCUMENTS 3,631,765 1/1972 Neumeister ..... 92/52

4,261,252 4/1981 Senn ..... 92/117

*Primary Examiner*—Edward K. Look

*Assistant Examiner*—Thomas E. Lazo

*Attorney, Agent, or Firm*—Oblon, Spivak, McClelland, Maier & Neustadt, P.C.

[57] ABSTRACT

A rotation-preventing mechanism for regulating the free rotation of an outer piston in a boosting cylinder apparatus is composed of at least one engaged groove formed in the inner surface of a cylinder tube integrally with the cylinder hole and at least one engaging member that is mounted on the outer circumference of the outer piston and fitted in the engaged groove in such a way as to be moved along the engaged groove.

7 Claims, 6 Drawing Sheets

FLUID-PRESSURE CYLINDER APPARATUS

BACKGROUND OF THE INVENTION

1. Field of the Invention

The present invention relates to a fluid-pressure boosting cylinder apparatus that is compact, provides a high thrust, and is designed to output the total force of a fluid pressure acting on multiple pressurized surfaces, and in particular, to a fluid-pressure boosting cylinder apparatus having a rotation-preventing mechanism for regulating the free rotation of a piston.

2. Description of the Prior Art

FIG. 7 shows an example of a fluid-pressure boosting cylinder apparatus of this kind. A fluid pressure cylinder body 1 in this cylinder apparatus comprises a cylinder tube 2; and a head cover 3 and a rod cover 4 are screwed into the respective axial ends of the cylinder tube 2 in an air-tight manner.

An outer piston 5 that slides through the cylinder tube 2 in an air-tight manner consists of an outer rod 6 that penetrates the rod cover 4 in an air-tight manner, and A tube head 7 is screwed into the tip of the outer rod 6. An inner rod 9, one end of which is fixed to the head cover 3, penetrates the center of the outer piston 5 in an air-tight manner and has an inner piston 10 attached to its tip. The outer piston 5 and the outer rod 6 can slide freely relative to the inner piston 10 and inner rod 9 fixed to the fluid pressure cylinder body 1.

In addition, an inner tube 9*a* is provided in the inner rod 9, and the inner rod 9 and the inner tube 9*a* constitute a double pipe.

In this cylinder apparatus, when compressed air is supplied from a supply and ejection port 12*a* provided in the head cover 3 to a pressure chamber 14 between the head cover 3 and the outer piston 5 and supplied to a pressure chamber 15 between the inner piston 10 and the tube head 7 through a channel 13*a* in the inner tube 9*a,* the outer piston 5, outer rod 6, and tube head 7 integrally move leftward in FIG. 7. In this case, because the thrust of the cylinder apparatus is equal to the total force of fluid pressure supplied to the pressure chambers 14 and 15, this cylinder apparatus provides a larger thrust than a conventional cylinder apparatus having only one piston.

In addition, when compressed air is supplied to a pressure chamber 16 between the outer piston 5 and the inner piston 10 through a channel 13*b* between the inner rod 9 and the inner tube 9*a,* the outer piston 5 returns to the illustrated state.

A boosting cylinder apparatus with such a configuration has the advantage of providing high power despite its small size, but is disadvantageous in that a rotation-preventing mechanism for regulating the free rotation of the piston can not be provided easily due to the structure of the apparatus. More specifically, a conventional cylinder apparatus having only one piston allows a rotation-prevention mechanism to be simply provided by using a square shaft and a square hole as the rod and its sliding hole, but in a boosting cylinder apparatus, because the inner piston is slidably accommodated inside the rod, a square shaft cannot easily be used as the rod. In addition, since the high power obtained results in a large torque acting on the rod, a rotation preventing mechanism consisting of such a square shaft and a square hole cannot provide sufficient strength easily.

In addition, a shaft capable of guiding the operation of the piston toward the exterior of the cylinder tube 2 may be provided parallel with the cylinder tube 2 and designed to have a rotation-preventing function. Since the mounting of this shaft, however, may increase the size of the cylinder apparatus or complicate its structure, such a shaft is not desirable.

SUMMARY OF THE INVENTION

It is the main object of this invention to form in a boosting cylinder apparatus a rotation-preventing mechanism for preventing the free rotation of a piston, in such a way that sufficient strength is maintained using a simple configuration.

It is another object of this invention to install the rotation-preventing mechanism inside the cylinder apparatus, to enable the rotation-preventing mechanism to be configured simply and inexpensively without increasing the size of the cylinder apparatus or adding a special seal mechanism.

To achieve these aims, this invention provides a boosting cylinder apparatus that includes a rotation preventing mechanism for a piston. The rotation-preventing mechanism is composed of at least one engaged groove formed in the inner surface of a cylinder body integrally with a cylinder hole; and at least one engaging member that is mounted on the outer circumference of an outer piston, is fitted in the engaged groove, and can move freely along the engaged groove.

The rotation-preventing mechanism according to this invention can be configured by simply forming the engaged groove along the cylinder hole and mounting on the outer circumference of the outer piston the engaging member that is fitted in the engaged groove. Thus, it has a very simple configuration and sufficient strength.

In addition, this invention eliminates the need to provide a separate space in which the rotation-preventing mechanism is installed and to mount a special member therein, thereby avoiding the need to increase the size of the cylinder apparatus and add a special seal mechanism.

According to one specific embodiment of this invention, the engaging member consists of a key that is fitted in the engaged groove. Bushes are mounted on the respective sides of the key and slidably contact the respective side walls of the engaged groove to facilitate the sliding of the key.

According to another specific embodiment, the engaging member consists of at least one roller that is designed to roll while abutting the side walls of the engaged groove.

In this case, two rollers are preferably provided in such a way that the first roller abuts one of the walls of the engaged groove while the second roller abuts the other groove wall.

A rail may be provided in that part of each side wall of the engaged groove which is contacted by the roller, in order to increase the strength of the groove walls.

According to this invention, two sets of the engaged groove and engaging member are preferably provided symmetrically relative to the center of the cylinder hole.

DETAILED DESCRIPTION OF THE INVENTION

Figure 1:
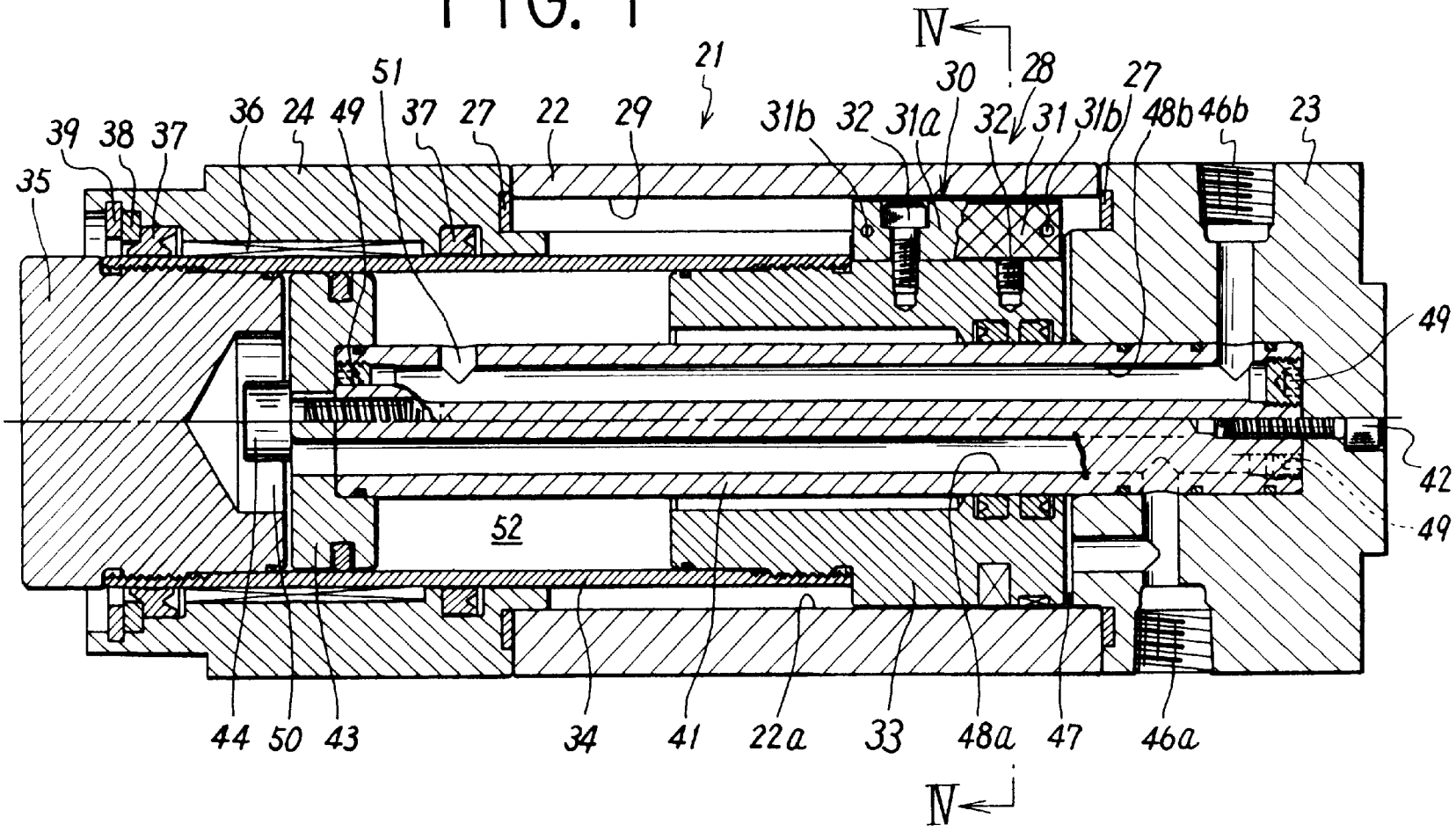
FIG. 1 is a sectional view showing a first embodiment of a cylinder apparatus according to this invention.
Figure 2:
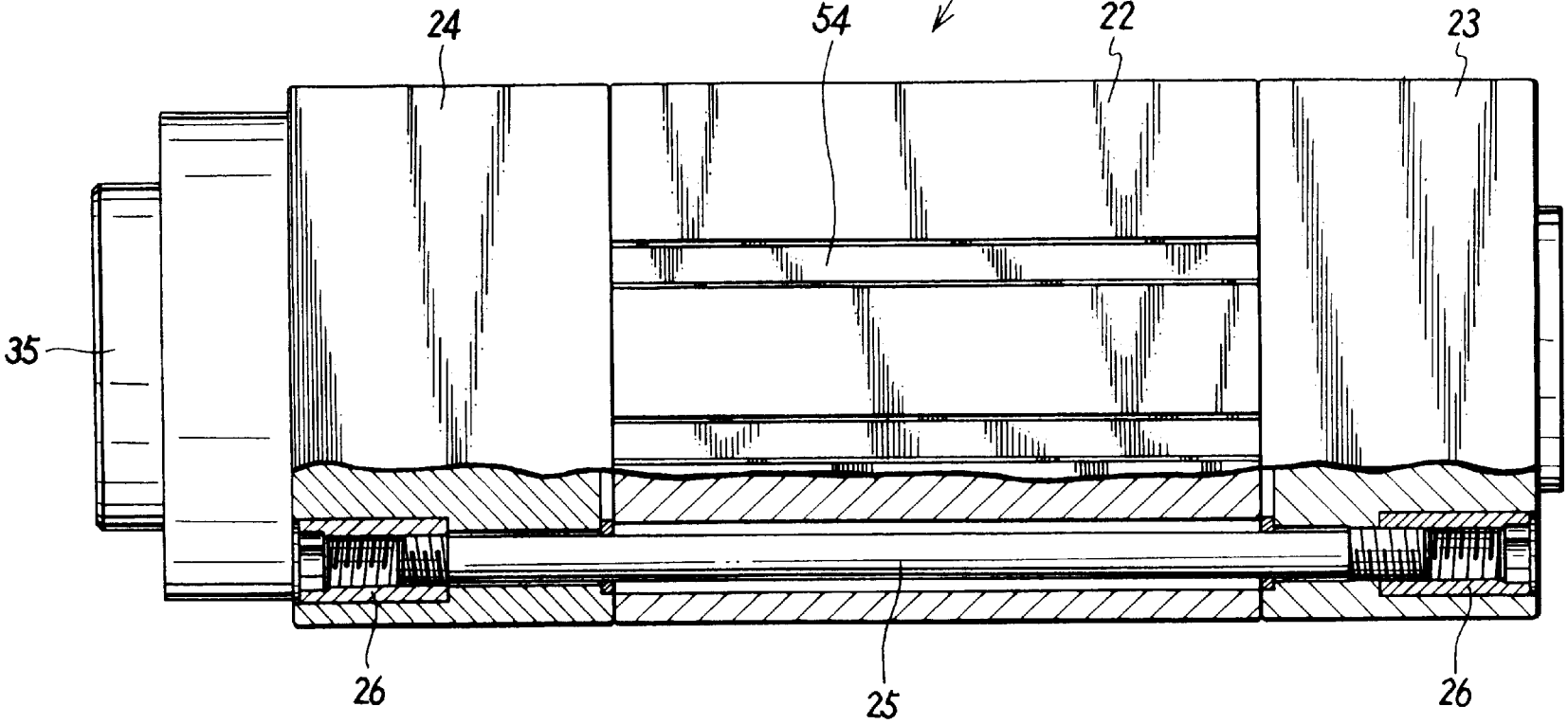
FIG. 2 is a front view of FIG. 1 with its integral part in small pieces.
Figure 3:
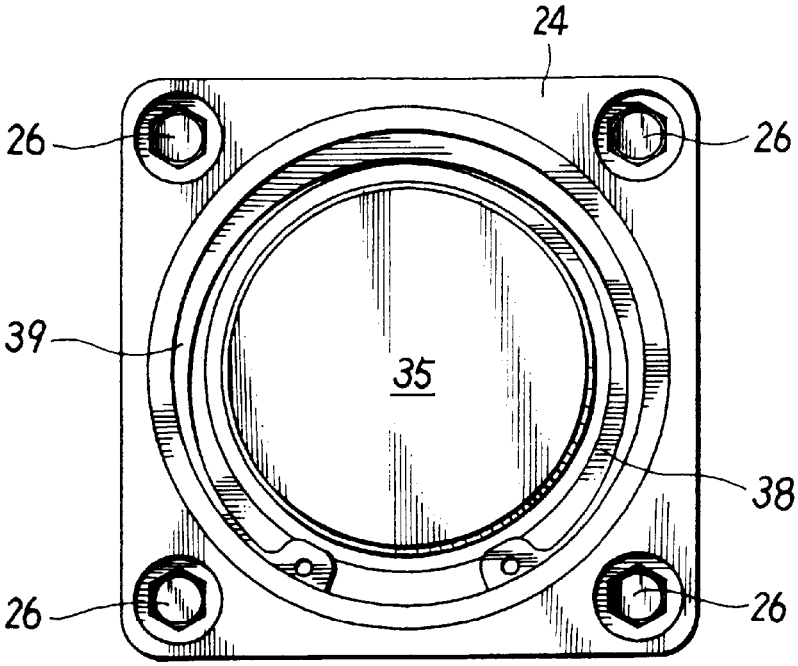
FIG. 3 is a left side elevational view of FIG. 1.

FIGS. 1 to 4 show a first embodiment of a fluid-pressure cylinder apparatus according to this invention. The cylinder body 21 is composed of a cylinder tube 22 having an almost square cross section and having a circular cylinder hole 22*a* inside. A head cover 23 and a rod cover 24 are attached to the respective axial ends of the cylinder tube and having similar appearances. The members 22, 23, and 24 are integrally assembled using multiple connecting bolts 25 shown in FIG. 2 passing through holes formed in the corners of each member. Nuts, 26 are screwed onto the respective ends of each bolt. The abutting surface between the cylinder tube 22 and the covers 23 and 24 is sealed in an air-tight manner using a gasket 27. See FIG. 1.

An outer piston 33, which is the first pressurized member, is slidably housed in the cylinder hole 22*a*. The proximal end of a hollow cylindrical outer rod 34 is attached to the outer piston 33. The tip of the outer rod 34 extends to the exterior of the cylinder body 21 while being slidably supported by a bearing member 36 provided on the inner circumferential surface of the rod cover 24, and a tube head 35, which is the second pressurized member, is screwed into the tip of the outer rod 34 in an air-tight manner. In addition, seal members 37, which seal the outer circumferential surface of the outer rod 34 in an air-tight manner, are attached to the rod cover 24, and the external seal member 37 is prevented from slipping out from the rod cover 24 by an annular presser plate 38 and a locking ring 39.

The proximal end of an inner rod 41 is fixed firmly in a recessed portion formed in the center of the inner side of the head cover 23, using multiple of mounting bolts 42. The inner rod 41 slidably penetrates the center of the outer piston 33 in an air-tight manner and extends into the outer rod 34, and has an inner piston 43 fixed firmly to its tip using multiple mounting bolts 44 in such a way that the piston 43 can slide relative to the outer rod 34.

Thus, the inner rod 41 and the inner piston 43 are integrated with the cylinder body 21, whereas the outer piston 33 and the outer rod 34 are connected together in such a way as to slide relative to the cylinder body 21, the inner rod 41 and the piston 43. The pressurized surface of the outer piston 33 is shaped like a ring in such a way as to surround the inner rod 41.

Two ports 46*a* and 46*b*, which supply and eject compressed air, are formed in the head cover 23. The first port 46*a* is in communication with the first pressure chamber 47 between the head cover 23 and the outer piston 33 and is in communication with a second pressure chamber 50 between the inner piston 43 and the tube head 35 through a channel 48*a* formed in the inner rod 41. In addition, the second port 46*b* is in communication with a third pressure chamber 52 between the outer piston 33 and the inner piston 43 through a channel 48*b* formed in the inner rod 41.

Figure 4:
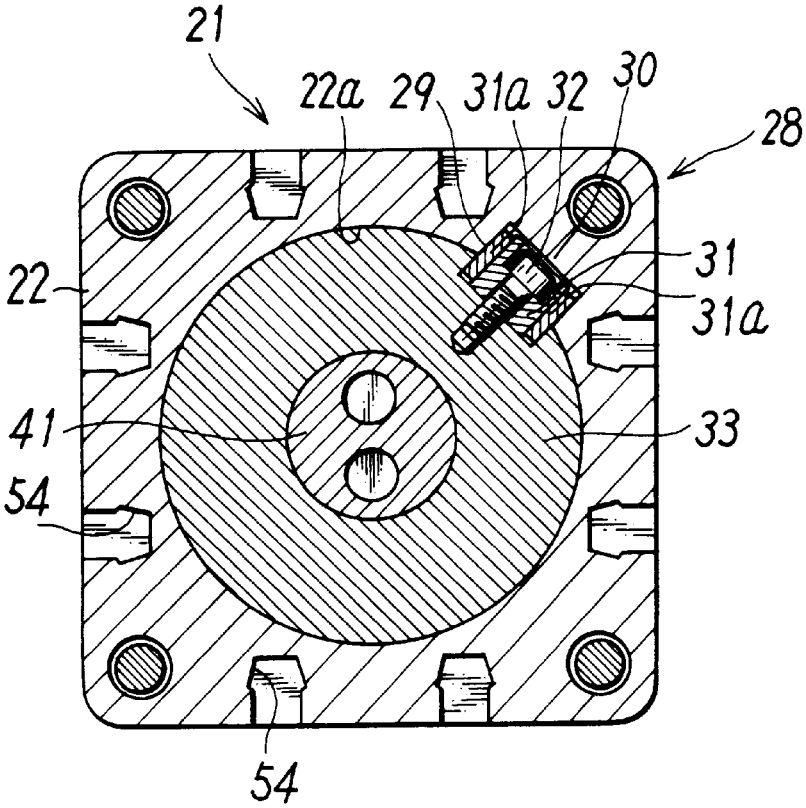
FIG. 4 is a sectional view along line IV—IV in FIG. 1.

In FIG. 4 a mounting groove 54 is provided in the outer circumferential surface of the cylinder tube 22 and in which a position-detecting sensor (not shown) for detecting the position of the outer piston 33 is mounted.

FIG. 1 shows a state in which compressed air is supplied to the third pressure chamber 52 through the second port 46*b* while the air in the first and second pressure chambers 47 and 50 is ejected to the exterior through the first port 46*a*. At this point, the outer piston 33 and the outer rod 34 are located in their rightward movement terminal positions.

When compressed air is supplied to the first and second pressure chambers 47 and 50 through the first port 46*a* the air in the third pressure chamber 52 is ejected to the exterior through the second port 46*b*, the outer piston 33 and the outer rod 34 move leftward in FIG. 1. In this case, since the thrust of the cylinder apparatus, that is, the thrust of the outer rod 34, is equal to the total force of fluid pressure acting on the pressurized surface of the outer piston 33 and the pressurized surface of the tube head 35, this apparatus provides a higher power than a normal cylinder apparatus having only one piston.

A rotation-preventing mechanism 28 for regulating the free rotation of the outer piston 33 is formed between the cylinder body 21 and the outer piston 33. The rotation-preventing mechanism 28 consists of an engaged groove 29 formed in the inner surface of the cylinder tube 22 along its axial direction in such a way as to be integrated with the cylinder hole 22*a*. An engaging member 30 is mounted on the outer circumferential surface of the outer piston 33 and is slidably fitted in the engaged groove 29.

The engaging member 30 consists of a key 31 fixed to the outer surface of the outer piston 33 using a mounting screw 32. Bushes 31*a* are mounted on the respective sides of the key 31 using multiple pins 31*b*. The bush 31*a* slidably contacts both side walls of the engaged groove 29 to facilitate the sliding of the key 31.

The rotation-preventing mechanism 28 reliably regulates the free rotation of the outer piston 33 around the axis. The bushes 31*a*, 31*a* mounted on the respective sides of the key 31 serve to facilitate the sliding of the outer piston 33.

Furthermore, since the engaged groove 29 is formed in the inner surface of the cylinder tube 22 and the engaging member 30 that is fitted in the engaged groove 29 is mounted on the outer circumference of the outer piston 33, this configuration is very simple and provides sufficient strength. In addition, this configuration obviates the need to provide a separate space in which the rotation-preventing mechanism 28 is installed and to mount a special member therein, thereby avoiding the need to increase the size of the cylinder apparatus.

Moreover, since the engaged groove 29 is formed integrally with the cylinder hole 22*a*, the rotation-preventing mechanism 28 is substantially accommodated inside the cylinder hole 22*a*, thereby obviating the need to provide a special mechanism for separately sealing the engaged groove 29. Thus, even if compressed air flows into the space between the cylinder hole 22*a* and the outer rod 34 behind the key 31 through the gap between the engaged groove 29 and the key 31, it will not leak into the third pressure chamber 52 between the pistons because the space and the third pressure chamber 52 are partitioned by the outer rod 34 in an air-tight manner.

Although in the illustrated embodiment only one set of the engaged groove 29 and the engaging member 30 is formed, two sets may be provided symmetrically relative to the center of the cylinder hole 22*a*.

Figure 5:
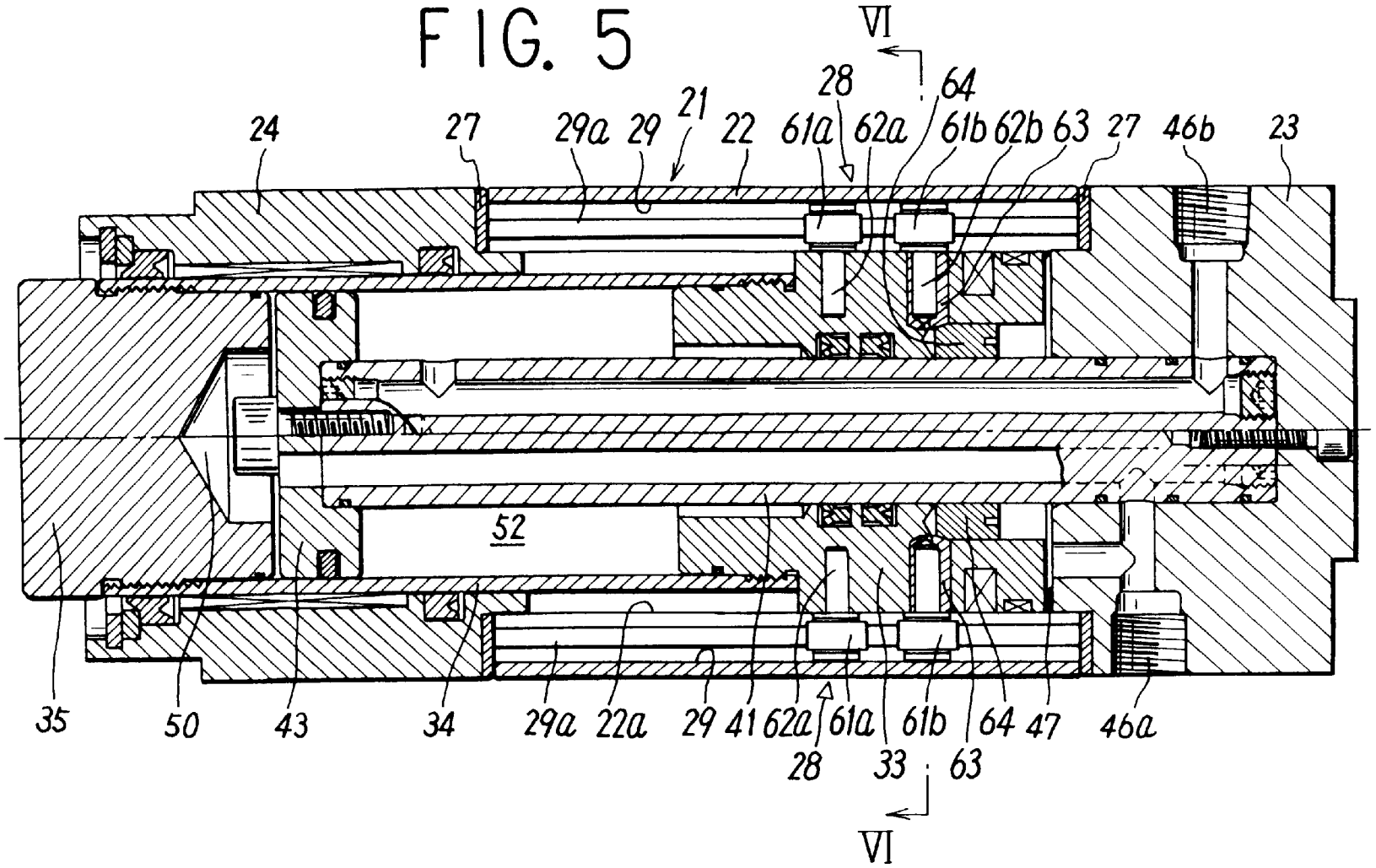
FIG. 5 is a sectional view showing a second embodiment of a cylinder apparatus according to this invention.
Figure 6:
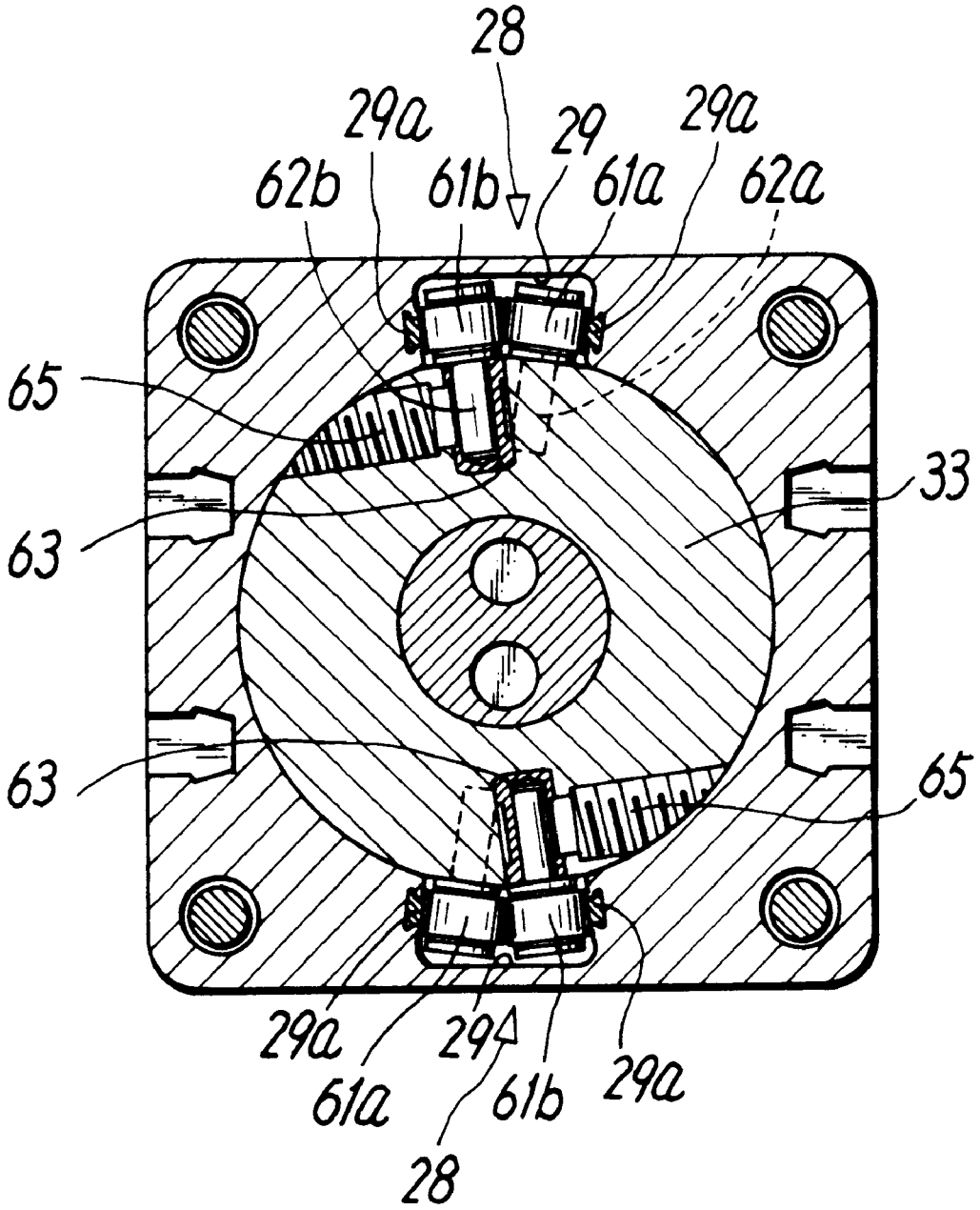
FIG. 6 is a vertical sectional view of FIG. 5.
Figure 7:
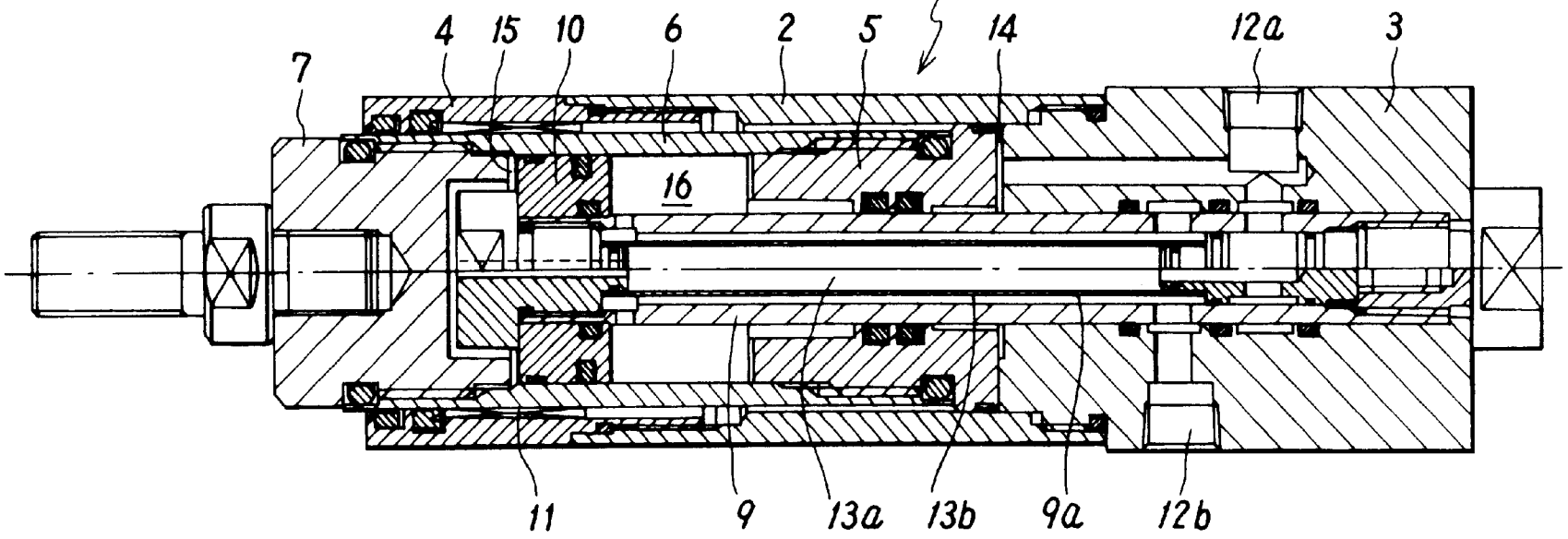
FIG. 7 (PRIOR ART)
FIG. 7 is a vertical sectional view of a prior art cylinder apparatus.

FIGS. 5 and 6 show a second embodiment which differs from the first embodiment in that the engaging member in the rotation preventing mechanism 28 consists of two rollers.

Two engaged grooves 29 are formed in the inner surface of the cylinder tube 22 of the cylinder body 21 at symmetrical positions relative to the center of the cylinder hole 22*a*. A guide rail 29*a* is attached to the right and left side walls of the engaged groove 29 to increase the strength of the groove walls.

On the other hand, two rollers 61*a* 61*b* are rotatably mounted on the outer circumference of the outer piston 33 opposite the two engaged grooves 29. The first roller 61*a* rolls while abutting the guide rail 29*a* on one of the walls of the engaged groove 29, whereas the second roller 61*b* rolls while abutting the guide rail 29*a* on the other groove wall.

A shaft 62*b* of the second roller 61*b* is fixed firmly to the outer piston 33, and a shaft 62*a* of the first roller 61*a* is supported in such a way as to be decentered with respect to a cylindrical mounting member 63 rotatably mounted in the outer piston 33. The mounting member 63 has a gear portion resembling a bevel gear that engages with an adjustment gear 64 rotatably mounted around the inner rod 41. By turning the adjustment gear 64 to rotate the mounting member 63 through a small angle, the first roller 61*a* can be eccentrically swivelled to adjust the gap between the two rollers 61*a* and 61*b* to the width of the engaged groove 29, thereby enabling the two rollers 61*a*, 16*b* to firmly abut the respective sides of the engaged wall 29.

A recessed groove is formed in the outer circumferential surface of the mounting member 63, and the tip of a locking member 65 provided on the outer piston 33 in FIG. 6 is fitted in the recessed groove, thereby allowing the mounting member 63 to be attached to the outer piston 33.

Since the other configuration of the second embodiment is the same as that of the first embodiment, the same major components in the figures have the same reference numerals and their detailed description is omitted.

Although in the second embodiment the engaging member 30 consists of the two rollers 61*a* and 61*b*, it may consist of only one roller. In this case, the one roller is fitted in the engaged groove 29 in such a way as to maintain a small gap within the groove 29.

In addition, although the second embodiment shows in FIG. 5 two sets of the engaged groove 29 and the engaging member 30 formed in such a way as to be mutually separated by 180°, only one set may be provided.

Furthermore, in each of the above embodiments, the engaged groove 29 is formed in a straight line in the axial direction of the cylinder hole 22*a*, but it may be formed spirally along the cylinder hole to enable the outer piston 33 to move back and forth while rotating through a specified angle.

Thus, this invention can form in a boosting cylinder apparatus a rotation-preventing mechanism 28 for preventing the free rotation of a piston, in such a way that sufficient strength is maintained using a simple configuration. In addition, the rotation-preventing mechanism 28 is installed inside the cylinder apparatus to enable the rotation-preventing mechanism 28 to be configured simply and inexpensively without increasing the size of the cylinder apparatus or adding a special seal mechanism.

What is claimed is:

1. A fluid pressure cylinder apparatus comprising:

a cylinder body having a cylinder hole inside;

an outer piston slidably accommodated in said cylinder hole;

a hollow outer rod connected to the outer piston such that a tip of the outer rod extends from said cylinder body to an exterior;

an inner piston slidably accommodated inside the outer rod and fixed to said cylinder body using an inner rod that penetrates said outer piston;

a tube head mounted at the tip of said outer rod opposite said inner piston;

a first pressure chamber on one side of said outer piston;

a second pressure chamber between said inner piston and said tube head;

a third pressure chamber between said outer piston and said inner piston;

a first port leading to said first and second pressure chambers;

a second port leading to said third pressure chamber;

a rotation-preventing mechanism for preventing free rotation of said outer piston;

wherein said rotation-preventing mechanism is composed of at least one engaged groove formed in an inner surface of said cylinder body integrally with the cylinder hole and at least one engaging member mounted on an outer circumference of said outer piston and fitted in said engaged groove so as to move along the engaged groove;

wherein said engaging member includes a key that is fitted in the engaged groove and bushes mounted on respective sides of the key, said bushes slidably contacting respective side walls of said engaged groove to facilitate sliding of the key.

2. A fluid pressure cylinder apparatus comprising:

a cylinder body having a cylinder hole inside;

an outer piston slidably accommodated in said cylinder hole;

a hollow outer rod connected to the outer piston such that a tip of the outer rod extends from said cylinder body to an exterior;

an inner piston slidably accommodated inside the outer rod and fixed to said cylinder body using an inner rod that penetrates said outer piston;

a tube head mounted at the tip of said outer rod opposite said inner piston;

a first pressure chamber on one side of said outer piston;

a second pressure chamber between said inner piston and said tube head;

a third pressure chamber between said outer piston and said inner piston;

a first port leading to said first and second pressure chambers;

a second port leading to said third pressure chamber;

a rotation-preventing mechanism for preventing free rotation of said outer piston;

wherein said rotation-preventing mechanism is composed of at least one engaged groove formed in an inner surface of said cylinder body integrally with the cylinder hole and at least one engaging member mounted on an outer circumference of said outer piston and fitted in said engaged groove so as to move along the engaged groove;

wherein said engaging member includes at least one roller that rolls while abutting side walls of said engaged groove.

3. A fluid pressure cylinder apparatus according to claim 2, wherein two rollers are provided such that a first roller abuts one of the side walls of the engaged groove while a second roller abuts the other side wall of the engaged groove.

4. A fluid pressure cylinder apparatus according to claim 3, wherein the first roller has a shaft supported by a mounting member rotatably mounted in said outer piston such that the shaft is decentered with respect to the mounting member, and wherein the mounting member is rotated to move said first roller eccentrically in order to adjust a gap between the two rollers to a width of the engaged groove.

5. A fluid pressure cylinder apparatus according to claim 2, wherein a rail is provided in a part of each side wall of said engaged groove, said part being contacted by the on roller in order to increase strength of the side walls of said engaged groove.

6. A fluid pressure cylinder apparatus comprising:

a cylinder body having a cylinder bole inside;

an outer piston slidably accommodated in said cylinder hole;

a hollow outer rod connected to the outer piston such that a tip of the outer rod extends from said cylinder body to an exterior;

an inner piston slidably accommodated inside the outer rod and fixed to said cylinder body using an inner rod that penetrates said outer piston;

a tube head mounted at the tip of said outer rod opposite said inner piston;

a first pressure chamber on one side of said outer piston;

a second pressure chamber between said inner piston and said tube head;

a third pressure chamber between said outer piston and said inner piston;

a first port leading to said first and second pressure chambers;

a second port leading to said third pressure chamber;

a rotation-preventing mechanism for preventing free rotation of said outer piston;

wherein said rotation-preventing mechanism is composed of at least one engaged groove formed in an inner surface of said cylinder body integrally with the cylinder hole and at least one engaging member mounted on an outer circumference of said outer piston and fitted in said engaged groove so as to move along the engaged groove;

wherein two sets of said engaged groove and said engaging member are provided symmetrically relative to a center of the cylinder hole.

7. A fluid pressure cylinder apparatus comprising:

a cylinder body having a cylinder hole inside;

an outer piston slidably accommodated in said cylinder hole;

a hollow outer rod connected to the outer piston such that a tip of the outer rod extends from said cylinder body to an exterior;

an inner piston slidably accommodated inside the outer rod and fixed to said cylinder body using an inner rod that penetrates said outer piston;

a tube head mounted at the tip of said outer rod opposite said inner piston;

a first pressure chamber on one side of said outer piston;

a second pressure chamber between said inner piston and said tube head;

a third pressure chamber between said outer piston and said inner piston;

a first port leading to said first and second pressure chambers;

a second port leading to said third pressure chamber;

a rotation-preventing mechanism for preventing free rotation of said outer piston;

wherein said rotation-preventing mechanism is composed of at least one engaged groove formed in an inner surface of said cylinder body integrally with the cylinder hole and at least one engaging member mounted on an outer circumference of said outer piston and fitted in said engaged groove so as to move along the engaged groove;

wherein said engaged groove is formed spirally along the cylinder hole.

* * * * *